United States Patent [19]

Kjersem

[11] Patent Number: 4,595,234

[45] Date of Patent: Jun. 17, 1986

[54] ROCKING CHAIR

[76] Inventor: Jens A. Kjersem, Einarvikgaten 1, 6000 Ålesund, Norway

[21] Appl. No.: 662,568

[22] Filed: Oct. 19, 1984

[51] Int. Cl.[4] ..... A47C 7/02

[52] U.S. Cl. ..... 297/258; 297/270; 297/458

[58] Field of Search ..... 297/258, 270, 272, 458, 297/460, 310, 196

[56] References Cited

U.S. PATENT DOCUMENTS

| | | | |
|---|---|---|---|
| 1,983,206 | 12/1934 | Witzel | 297/270 |
| 2,722,967 | 11/1955 | Reinholz | 297/270 |
| 3,376,070 | 4/1968 | Johnson | 297/458 |
| 3,556,591 | 1/1971 | Smith | 297/270 X |
| 3,945,651 | 3/1976 | Boswinkel | 297/310 X |
| 4,489,982 | 4/1968 | Morrow | 297/458 |

FOREIGN PATENT DOCUMENTS

| | | | |
|---|---|---|---|
| 17450 | 10/1980 | European Pat. Off. | 297/258 |
| 899854 | 12/1953 | Fed. Rep. of Germany | 297/458 |
| 285979 | 9/1952 | Switzerland | 297/196 |

*Primary Examiner*—William E. Lyddane

*Assistant Examiner*—Peter A. Aschenbrenner

*Attorney, Agent, or Firm*—Browdy and Neimark

[57] ABSTRACT

A rocking chair with rockers wherein each rocker has a fulcrum between a forward rocker section and a rearward rocker section for tilting the chair into a forward or a backward position, respectively. The chair seat and backrest are connected to the forward ends of the rockers via resilient arms which form acute angles to the rockers and whose upper, substantially horizontal parts support the rear section of the seat, which section is lower than the forward section of the seat. The backrest comprises a straight, fixed, horizontal body disposed at a height of less than 30 cm, preferably about 22 cm, above the lowest section of the seat, which corresponds to the height of the fifth lumbar vertebra of a person sitting in the chair. The vertical thickness of the backrest body is less than 11 cm, preferably 8 cm or less, and its forward surface is approximately vertical when the chair has been tipped into its backward position. In a preferred embodiment, the lower edge of the support body will thus lie 14–15 cm above the lower, rear section of the chair seat.

9 Claims, 3 Drawing Figures

ROCKING CHAIR

The present invention relates to a rocking chair with rockers of the type recited in the preamble of the appurtenant independent patent claim 1.

Rocking chairs, conventionally, have a backrest which is intended to support a large area of the back of the person sitting in the chair, usually from the small of the back up to the shoulderblade region in a normal, upright seated position, and further up to the shoulder and neck region in the case of an easy chair.

Poor posture while seated is one of the most common causes of muscle and back strain today. It has been proved that an important way to avoid such strain is to assume a sitting position in which the backbone (columna spinalis) is held straight, not, curved forwardly, i.e., a person should not sit and work with his back bent or curved forwardly for an extended period of time.

A number of furniture products are on the market whose aim is to encourage as straight a back as possible while still retaining the normal anatomical curvature of the spine.

The purpose of the present invention is to provide a rocking chair designed to assume two rocking positions, as described in the preamble of the claim, in which the backrest provides good support for the lowermost part of the spine, while the upper part of the body, when the chair is rocked, can move freely in relation to the backrest. The object of the invention, therefore, is to help the person seated in the chair to achieve a posture that creates less strain on the back, whether the person is working, or sitting in an active work situation.

This is obtained according to the invention in that the backrest comprises a straight, fixed, horizontal body, which is disposed at a height above the lowest section of the chair seat which corresponds to the distance from the middle of the sacrum up to the fifth lumbar vertebra of the spine of the person sitting in the chair. The backrest thus comes into contact with and supports a specific section of the spinal column, namely, the upper half of the sacrum, which lies below the fifth lumbar vertebra of the backbone and between the pelvic bones. In addition, the backrest will also come into contact with and support the posterior part of the pelvis, known as the spinae iliaca posterior, or posterior superior iliac spine (PSIS). Thus, a small surface constituted by said backrest body supports the upper section of the sacrum, and optionally the fifth lumbar vertebra, and this presses the backbone forward into a balanced position in which further back support is unnecessary.

Due to the fact that the body weight leans against the backrest body, and this body has a smaller support surface than on a conventional chair, the pressure per $cm^2$ of the body against this support surface will be greater than is normally the case. The lower the location of the backrest against the spinal column, the more weight is supported by the backrest. By placing this support surface (the backrest body) against the above-mentioned part of the spinal column (the upper part of the sacrum and pelvis), the person sitting in the chair will receive a relatively strong pressure against this particular part of the spinal column. This relatively strong pressure will feel comfortable to most people, and especially people who have chronic back pain have a great need for this uniquely constructed backrest.

When the upper part of the pelvis and the sacrum obtain a strong pressure from the rear, and consequently can more easily tilt forward, a physiological biomechanical effect results. The backbone automatically and naturally stretches outwardly and upwardly to help the body assume a naturally balanced position in relation to the sacrum and pelvis.

In the backwardly tilted position of the rocking chair, the pressure against the backrest body will be greater than when the chair is in its forwardly tilted position. Because the backrest support follows the movements of the chair when it has been tilted forward, the pelvis and sacrum will be urged to tilt even farther forward. In this position, the pelvis will assume a more balanced position, and thus will not lean so heavily against the support body, but will require only light support. This light support prevents the upper pelvis and sacrum from collapsing backwardly. If the pelvis and sacrum should collapse backwardly, this would cause the rest of the backbone to curve forwardly, which is an undesirable position in an active, lengthy work situation.

The rocking chair of the invention will allow the user to exercise while sitting. Using the chair in a training program of repeated rocking movements on the chair rockers, the user can be taught to allow his backbone at all times to balance back and forth on each side of an imaginary straight line through the balance point of the backbone. The paravertebral muscles will thus be in constant movement during this active sitting exercise. Each time the rocking chair reaches its back-tilted position, the backrest will be pressed more forcefully against the special anatomical point on the spinal column (the upper pelvis and sacrum). This extra pressure creates a massaging and motion-imparting effect along the entire spinal column. A resilient or spring-like foundation on the chair will lessen the chair's rearward movement and urge it forward again, assisted by a slight pressure executed by the person seated in the chair from the contact point of the backrest, therefore creating a stronger spring effect. This is also good exercise for the abdominal muscles.

Horseback riding is considered by many people to be an excellent way of inducing correct posture and strengthening the back muscles. Utilizing a chair with a resilient, springy foundation, constructed such that the spring movement imparts a to and fro pendulum movement to the backrest, rather than an up and down movement, the chair's movements will simulate the gallop in horseback riding, where the rider actively follows the movements of the horse. In addition, by utilizing the chair's tilted rocking positions, the backrest has a massaging and motion-imparting effect on the user's spine, owing to its forceful contact against a particular anatomical point on the spinal column.

The characteristic features of the rocking chair are recited in the characterizing clause of the appurtenant independent claim 1, and in the succeeding dependent claims.

With a rocking chair having these characteristic features, the user will activate his spinal column as the chair is rocked, obtaining both an exercising effect with repeated rocking movements and, by alternating between the two tilted positions, obtaining a desirable change in the position of the back, which makes it less tiring to sit in a chair while performing work, or while engaged in a spectator activity or watching television.

The invention will be described in greater detail in the following with reference to the accompanying drawings, wherein.

Figure 1:
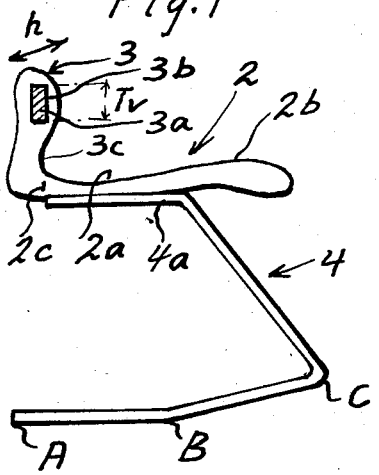
FIG. 1 shows the rocking chair in side view.
Figure 3:
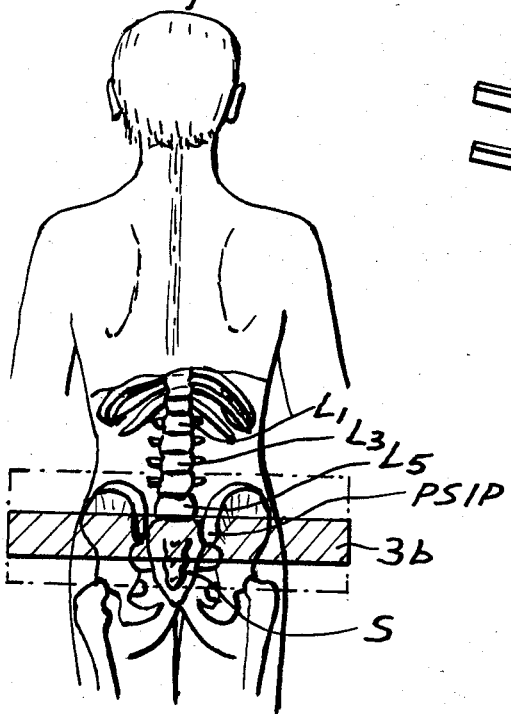
FIG. 3 is a schematic drawing of the spinal column and pelvis.

FIG. 1 shows the rocking chair with rockers 1, where each rocker has a fulcrum point B located between a forward, straight rocker section B-C and a rearward, straight rocker section B-A, for tilting the chair into a forward and a backward position, respectively. The seat 2 of the chair and the backrest 3 are joined to the forward ends C of the rockers 1 by springy, resilient arms 4, which form acute angles relative to the rockers 1, and whose upper, substantially horizontal parts 4*a* support the chair seat 2 at its rearward section 2*a* which is lower than its forward section 2*b*. The backrest 3 comprises a straight, fixed, horizontal body 3*a* whose forward surface 3*b* is approximately vertical when the chair is in the back-tilted position resting on the rocker section A-B. The backrest body 3*a* is disposed at a height of less than 30 cm, preferably about 22 cm, above the lowest section 2*a* of the chair seat 2, i.e., so that it extends up to the lower part of the fifth lumbar vertebra $L_5$ of an adult person sitting in the chair. The vertical thickness $T_v$ of the backrest body 3*a* is less than 11 cm, preferably 8 cm or less, and the backrest will thus provide support for the upper part of the small of the back, specifically the sacrum (S), as shown in FIG. 3 wherein the shaded region shows the forward surface 3*b* of the backrest body 3*a* which constitutes the support for the sacrum and the dorsal parts of the pelvis—the posterior superior iliac spine (PSIS)—lying on each side of this.

Figure 2:
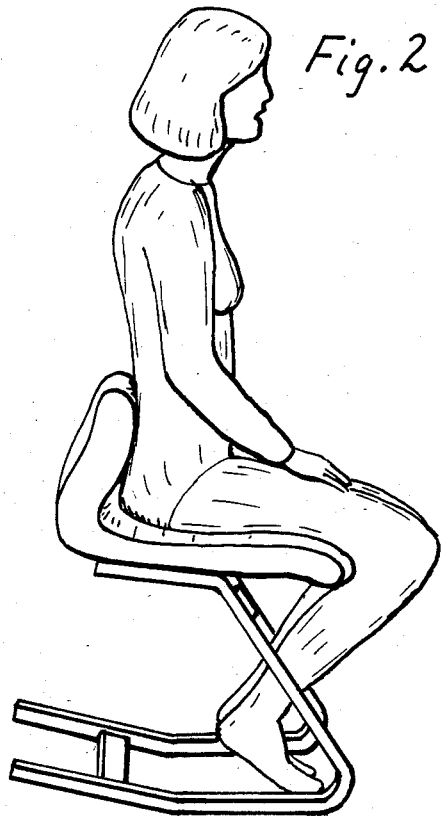
FIG. 2 shows the rocking chair in side view and in perspective, with a person seated in the chair which has been rocked into the forwardly tilted position.

The forward surface 3*b* of the backrest body 3*a* lies almost directly above the rear edge 2*c* of the chair seat 2. The backrest body 3*a* together with the rigid connections between its end sections and the chair seat 2, in the embodiment example shown herein, are embedded within a padded material 3*c* which gradually becomes integral with the padding of the seat 2. The padding of the backrest 3, as seen in FIGS. 1 and 2, is retracted somewhat in relation to the forward surface 3*b* of the backrest body 3*a*, such that the person sitting in the chair can place the lower part or bottom of the backbone, namely the sacrum S and the posterior superior iliac spine (PSIS) closely against the forward surface 3*b* of the backrest body 3*a* without the padding 3*c* interfering. The configuration of the seat 2 with a rearward section 2*a* which is lower than its forward section 2*b* causes the person sitting in the chair to try to sit as far back in the seat as possible, thus automatically ensuring that the discussed back support is obtained. Since the lower part of the support body begins just above the gluteal musculature, this musculature will not interfere with the firm contact of the backrest against the sacrum and pelvis.

The rear section 2*a* of the seat 2 is supported by the upper parts 4*a* of the resilient arms 4, and owing to the special sloping position of the resilient arms 4 between said upper parts 4*a* and the forward section B-C of the rockers, an arching, to and fro, springlike movement of the chair seat 2 is obtained about a point located at the forward ends C of the rockers 1. This arching, springlike movement of the chair seat together with the rocking movement of the chair itself about the fulcrum B of the rockers 1, results in a motion h as indicated by the arrow in FIG. 1, which induces an alternating movement, tilting forward and backwardly, of the person's back. This creates a mobilization of a telescopic-like movement at the back of the lower vertebrae of the backbone, which movement to a certain degree is comparable to the movements of the backbone during horseback riding.

To tilt the chair about the fulcrum B of the rockers 1, the person sitting in the chair shifts his body weight back and forth with his legs folded back beneath the chair seat 2 as shown in FIG. 2. The person also shifts his body weight to tilt the chair into either of its stationary positions—a back-tilted or a forward-tilted position. For example, when the chair is placed before a desk or worktable, the person rocks the chair into the forward position to bring his body into a suitable position for working at the desk surface, and can tilt the chair back into the rearward position, moving his body away from the worktable and at the same time giving his body a relaxed resting position with only said support against the sacrum.

The above discussed chair with a backrest body 3*a* in accordance with the invention can thus be used both as an ordinary chair for sitting and working, and as an exercise/therapeutic chair, in the latter case by exercising the back musculature and training the back (through the backrest's massaging and motion-imparting effect).

Having described my invention, I claim:

1. A rocking chair with rockers wherein each rocker has a fulcrum between a forward rocker section and a rearward rocker section for rocking the chair into a forward-tilted or back-tilted position, respectively, and wherein the chair seat and backrest are connected to the forward end of the rockers via resilient arms which form acute angles relative to the rockers and whose upper, substantially horizontal parts provide support for the chair seat, wherein the rear section of the chair seat is lower than its forward section in the back tilted position of the chair, and the backrest comprises a straight, fixed, horizontal body disposed at a height of less than 30 cm above the lower section of the seat, which corresponds to the height of the fifth lumbar vertebra on an adult person sitting in the chair, the vertical thickness of said backrest body being less than 11 cm, and the forward surface of the backrest being approximately vertical when the chair has been tilted into the back-tilted position, resting on a horizontal surface.

2. A rocking chair according to claim 1, characterized in that the forward surface of the backrest body is disposed almost directly above the rear edge of the rear section of the chair seat.

3. A rocking chair according to claim 1, characterized in that the backrest body is embedded within a padded material which gradually becomes integral with the padding or the chair seat.

4. A rocking chair according to claim 1, characterized in that the rear section of the seat is supported by said upper substantially horizontal parts of the resilient arms.

5. A rocking chair according to claim 1, wherein said straight, fixed, horizontal body is disposed at a height of about 22 cm.

6. A rocking chair according to claim 2, wherein said straight, fixed, horizontal body is disposed at a height of about 22 cm.

7. A rocking chair according to claim 1, wherein the vertical thickness of said backseat body is 8 cm or less.

8. A rocking chair according to claim 2, wherein the vertical thickness of said backseat body is 8 cm or less.

9. A rocking chair according to claim 5, wherein the vertical thickness of said backseat body is 8 cm or less.

* * * * *